US007493942B2

(12) United States Patent
Agee et al.

(10) Patent No.: US 7,493,942 B2
(45) Date of Patent: Feb. 24, 2009

(54) HEAT EXCHANGER

(75) Inventors: Keith D. Agee, Torrance, CA (US); Richard Paul Beldam, Torrance, CA (US); Roland L. Dilley, Jr., Lomita, CA (US)

(73) Assignee: Honeywell International, Inc., Morristown, NJ (US)

( * ) Notice: Subject to any disclaimer, the term of this patent is extended or adjusted under 35 U.S.C. 154(b) by 0 days.

(21) Appl. No.: 11/552,502

(22) Filed: Oct. 24, 2006

(65) Prior Publication Data

US 2007/0074858 A1 Apr. 5, 2007

Related U.S. Application Data

(62) Division of application No. 10/256,063, filed on Sep. 25, 2002, now Pat. No. 7,124,812.

(60) Provisional application No. 60/326,174, filed on Sep. 28, 2001.

(51) Int. Cl.
*F28F 3/08* (2006.01)
*F28F 13/08* (2006.01)

(52) U.S. Cl. ..... 165/174; 165/166; 165/146

(58) Field of Classification Search ..... 165/174, 165/166, 176

See application file for complete search history.

(56) References Cited

U.S. PATENT DOCUMENTS

| | | | | | |
|---|---|---|---|---|---|
| 1,510,807 | A * | 10/1924 | Soule | 165/180 |
| 3,525,390 | A * | 8/1970 | Rothman | 165/166 |
| 4,466,482 | A * | 8/1984 | Dorazio et al. | 165/145 |
| 4,593,749 | A * | 6/1986 | Schatz | 165/283 |
| 4,679,623 | A * | 7/1987 | Landry et al. | 165/166 |
| 5,107,923 | A * | 4/1992 | Sherman et al. | 165/159 |
| 5,465,783 | A * | 11/1995 | O'Connor | 165/134.1 |
| 6,997,250 | B2 * | 2/2006 | Dilley et al. | 165/174 |
| 2001/0017201 | A1 * | 8/2001 | Avequin et al. | 165/173 |
| 2003/0111210 | A1 * | 6/2003 | Tsujita et al. | 165/51 |
| 2007/0114013 | A1 * | 5/2007 | Augenstein et al. | 165/174 |

* cited by examiner

*Primary Examiner*—Allen J Flanigan

(57) ABSTRACT

Apparatus and method for cooling heated fluids, such as exhaust gases, flowing through a heat exchanger comprising one or more exhaust plenums and one or more coolant plenums, and providing increased coolant velocity in that portion of the coolant plenums contacting the inlet portion of the exhaust plenums. Local increased coolant velocity is provided by any means, including decreasing the area-in-flow of the coolant plenums wherein increased velocity is desired, shaping or baffling either or both inlet or outlet coolant tanks in fluidic contact with coolant plenums wherein increased velocity is desired, or a combination thereof.

12 Claims, 6 Drawing Sheets

HEAT EXCHANGER

CROSS-REFERENCE TO RELATED APPLICATION

This is a divisional application of U.S. patent application Ser. No. 10/256,063, titled "Heat Exchanger", filed Sep. 25, 2002, that application claiming the benefit of the filing of U.S. Provisional Patent Application Ser. No. 60/326,174, titled "Asymmetrical Heat Exchanger Core for Increasing Coolant Velocity", filed on Sep. 28, 2001, and the specifications and claims of those applications are incorporated herein by reference.

BACKGROUND OF THE INVENTION

1. Field of the Invention (Technical Field)

The present invention relates generally to heat exchangers for liquid cooling of internal combustion engines, particularly heat exchangers with increased efficiency by local increased coolant velocity.

2. Background Art

It is known in the general art of internal combustion engines to provide some system for exhaust gas recirculation (EGR). EGR involves the return to the engine's intake manifold of some portion of the engine exhaust. Exhaust gases are diverted from the exhaust manifold through a duct or conduit for delivery to the intake manifold, thereby allowing exhaust to be introduced to the combustion cycle, so that oxygen content is reduced, which in turn reduces the high combustion temperature that contributes to excessive $NO_x$ formation.

The EGR method of reducing exhaust emissions has drawbacks. A specific problem is that EGR is most effective when the gases are cooled, which problem can be solved in part by using heat exchangers. It is known to provide heat exchangers in conjunction with EGR systems, whereby the heated exhaust passes through a heat exchanger core, together with a suitable coolant separated from the exhaust by a wall or other means. Such coolers may be "multi-pass", in that either heated exhaust or coolant, or both, pass two or more times through the heat exchanger core. Exhaust gas enters a cooler at very high temperature and exits at much lower temperature.

Commercial diesel vehicles typically have significant cooling loads for heat exchangers employed in engine cooling, EGR systems and other applications. Prior art liquid cooled heat exchangers employing high temperature hot fluid, such as exhaust gas recirculated for emissions control, frequently result in boiling of the liquid coolant at low coolant flows. This phenomenon often results not from the bulk coolant temperature being too high but rather because the heat exchanger surface temperature exceeds the saturation temperature. The difference between the surface temperature and the liquid temperature, if high enough, can cause localized destructive film boiling to occur. The localized film boiling typically occurs in the gas inlet portion of the heat exchanger, where the temperature of the exhaust gas is highest. Coolant overheating and boiling can result in cracks and leaks in the heat exchanger, as well as performance degradation.

It is therefore desirable to provide a heat exchanger with variable coolant velocity at desired points to accommodate varying surface temperature issues. In particular, it is desirable to provide a heat exchanger with an increased coolant velocity proximate the gas inlet portion of the heat exchanger.

Against the foregoing background, the present invention was developed. The scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate two embodiments of the present invention and, together with the description, serve to explain the principles of the invention. The drawings are only for the purpose of illustrating preferred embodiments of the invention and are not to be construed as limiting the invention. In the drawings.

DESCRIPTION OF THE PREFERRED EMBODIMENTS

Best Modes For Carrying Out The Invention

The present invention relates to an improved heat exchanger and method for cooling heated fluids while limiting or inhibiting boiling of the coolant fluid. While a primary use of the present invention is for cooling exhaust gases, such as from an internal combustion engine, it is to be understood that the invention can be applied to any heated fluid to be cooled, whether such fluid is a hot gas or a hot liquid, and all such heated fluids are included within the understanding of exhaust gases discussed herein. The invention may thus be applied for cooling the exhaust gases flowing through an exhaust gas recirculation (EGR) system. The invention will find ready and valuable application in any context where heated exhaust is to be cooled, but is particularly useful in EGR systems installed on internal combustion engines, where exhaust is diverted and returned to the input of the power system. The apparatus of the invention may find beneficial use in connection with EGR systems used with diesel-fueled power plants, including but not limited to the engines of large motor vehicles.

The present invention, as further characterized and disclosed hereafter, ameliorates or eliminates certain problems associated with current methods for cooling recirculated exhaust in known EGR systems. Many EGR systems employ heat exchangers to cool exhaust gases before recirculating them to the engine's input manifold. The heat exchangers incorporated into EGR systems function according to generally conventional principles of heat transfer. The hot exhaust gases are directed through an array of tubes or conduits fashioned from materials having relatively high thermal conductivity. These hot gas conduits are placed in intimate adjacency with coolant conduits. For example, the exterior surfaces of the hot gas conduits may be in direct contact with the exteriors of the coolant conduits, or the hot gas conduits may be enveloped or surrounded by the coolant conduits so as to immerse the hot gas conduits in the flowing coolant itself, or heat transfer fins may extend from the hot gas conduits to or into the coolant conduits, or the like. Heat energy is absorbed from the exhaust by the gas conduits, and then transferred by conduction to the coolant conduits, where the excess heat energy is transferred away by convection. Very preferably, and in most applications necessarily, the hot gas never comes in direct contact with the flowing coolant, the two at all times being separated by at least the walls of the hot gas conduits. The foregoing functions of heat exchangers are well-known, and need no further elaboration to one skilled in the art.

Figure 1:
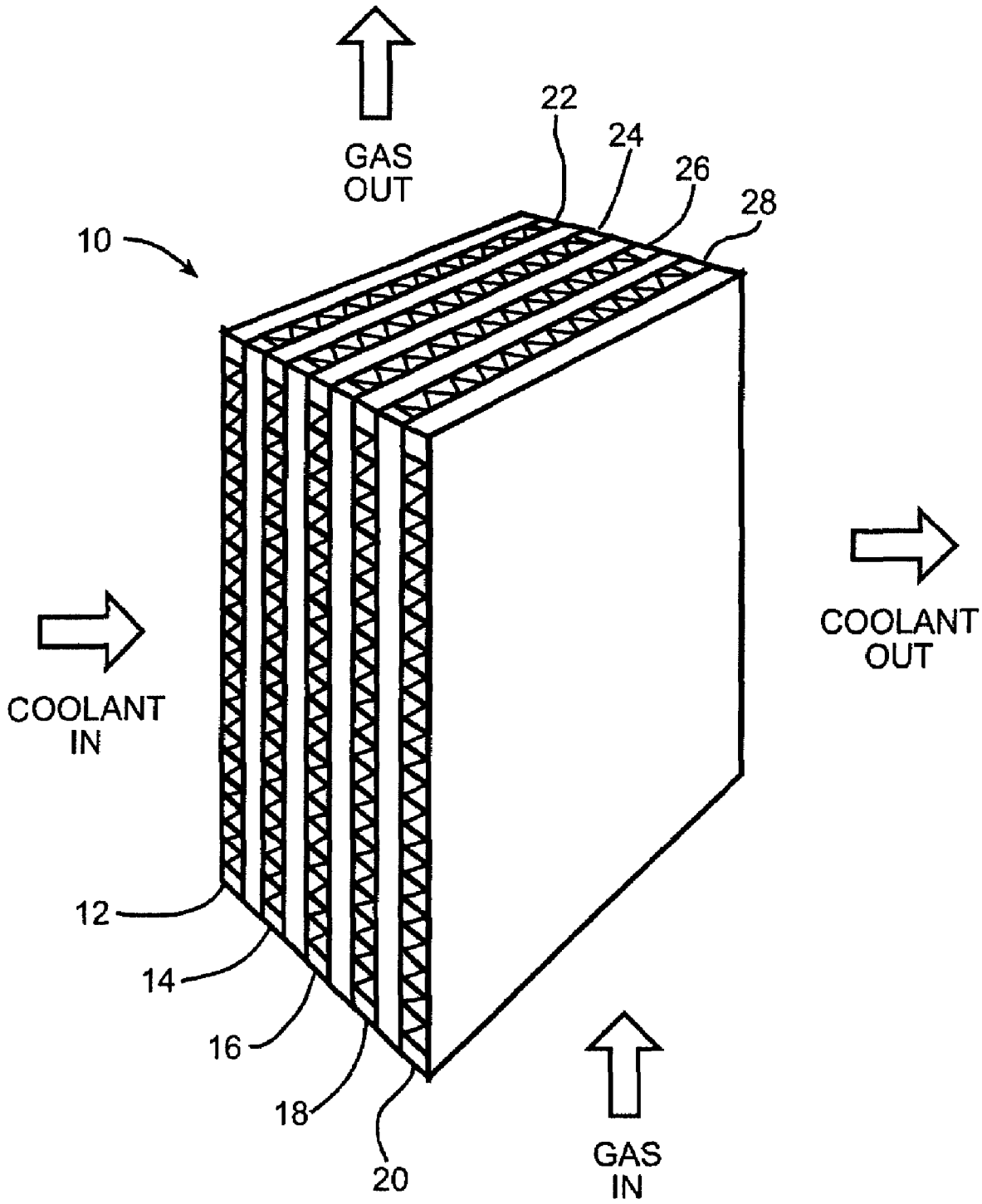
Fig. 1 Prior Art
FIG. 1 is a perspective, diagrammatic, bi-section view of an exhaust gas recirculation cooler from the prior art, showing a "single pass" exhaust gas and coolant configuration.

The present invention is placed in proper context by referring to FIG. 1, showing a heat exchanger or cooler known in the art. For clarity of illustration, FIG. 1 shows a prior art cooler in both vertical and horizontal section, to reveal the interior components of the device. Further, all intake and outlet manifolds are omitted from the drawing for the sake of clarity. The construction, configuration and operation of the cooler of FIG. 1 is within the knowledge of one skilled in the art, including the provision of appropriate manifolds. Referring to FIG. 1, it is seen that a typical core 10 is assembled from a collection of contiguous, parallel, walled plenums. Coolant plenums 12, 14, 16, 18, 20 are sandwiched between exhaust plenums 22, 24, 26, 28 in an alternating manner. Walled coolant plenums 12, 14, 16, 18, 20 contain and convey the flowing coolant (e.g. water, an aqueous mixture of ethylene glycol or the like). As seen in the figure, coolant plenums 12, 14, 16, 18, 20 as well as exhaust plenums 22, 24, 26, 28 preferably feature extended surfaces or fins (such as those defined by a single zigzag pleated or corrugated sheet disposed between the confronting walls) extending between their respective opposing walls, to define axial flow passages therein. Many variations of fins or extended variations are possible, including many presently known in the art, for promoting heat transfer, and it is not intended to restrict the present invention to any particular configuration for defining axial flow passages.

In FIG. 1, the coolant is directed to flow from the left of core 10 to the right, via the coolant passages in coolant plenums 12, 14, 16, 18, 20 as suggested by the large directional arrows for coolant flow of the figure. It is to be understood that the coolant flow as readily could be from the right to the left. In FIG. 1, coolant plenums 12, 20 are the outermost plenums of the core 10, with exhaust plenums 22, 24, 26, 28 being interior thereto. It is to be seen that in this configuration there is always one more coolant plenum than the number of exhaust plenums. While this configuration presents certain advantages, other configurations are possible and contemplated, including exterior most exhaust plenums.

Prior art core 10 shown in FIG. 1 is of a "single pass" exhaust variety, that is, the hot exhaust is passed between the coolant plenums 12, 14, 16, 18, 20 a single time before being returned to the engine intake manifold. "Double pass" cores are known, involving two passes of the exhaust gas through the core. "Multiple pass" cores, involving three or more passes of the exhaust gas through the core are known, but seldom encountered. In, for example, double pass exhaust cores, the hot exhaust flows in opposing directions during separate passes through the core 10. Hot gas flows from bottom to top (as viewed in FIG. 1) during the first pass through the core 10, and subsequently from top to bottom during the second pass. There is provided some conventional means, such as ordinary U-fittings joining the ends of corresponding passages, for reversing the hot gas direction of flow between passes through core 10. One or more sealing exhaust dividers is provided between opposing pairs of exhaust plenum walls to separate the first pass exhaust flow from the second-pass flow, typically without interfering with the coolant flow through coolant plenums 12, 14, 16, 18, 20. With reference to FIG. 1, an exhaust divider can be oriented vertically in core 10, such that the hot gas flow would first be top-to-bottom, then reversed on the second pass, or visa-versa. Alternatively, the exhaust divider can be oriented horizontally in core 10 of FIG. 1, in which instance the hot gas flow would first be downward, then reversed to be upward on the second pass, or visa-versa. In variations of such configuration it is possible that, for example, some exhaust plenums are used for flow in one direction, and others in another direction.

As indicated by the large directional arrows in FIG. 1, the hot exhaust flows through core 10 in directions perpendicular to the direction of coolant flow, i.e., the hot gas passages axes are disposed at ninety-degree angles relative to the coolant passages, despite that the hot gases and coolant are flowing in parallel plenums. Other known configurations provide for coolant flow and hot gas flow in parallel, rather than perpendicular, directions; the concepts of the present invention can readily be extended and applied in these alternative configurations.

Figure 2:
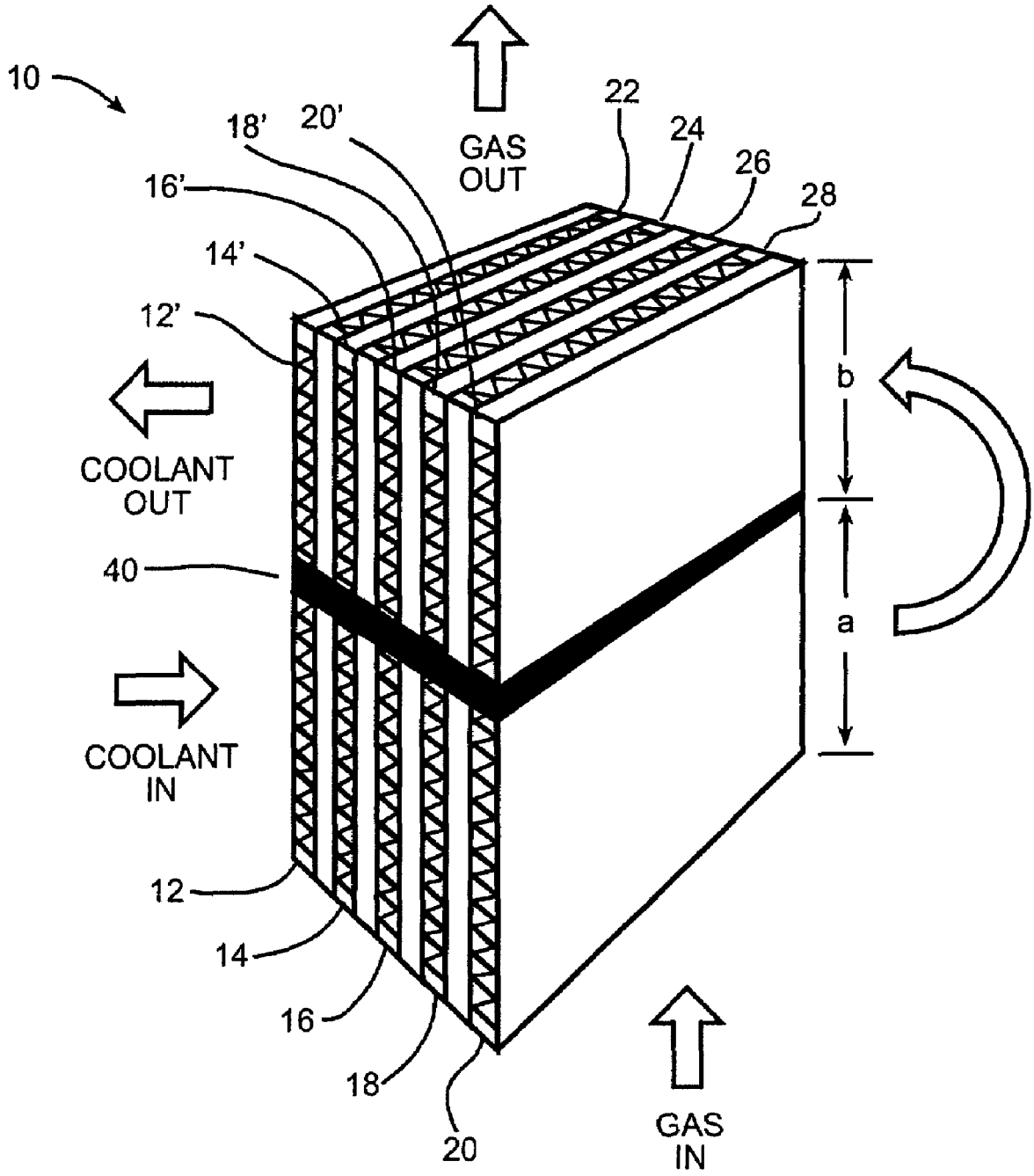
Fig. 2 Prior Art
FIG. 2 is a perspective, diagrammatic, bi-section view of an exhaust gas recirculation cooler from the prior art, showing a single pass exhaust gas configuration with a typical "two pass" coolant configuration of equal passage or equal area configuration.

FIG. 2 depicts a variant heat exchanger known in the art. The core of FIG. 2 is of a "two pass" coolant variety, that is, the coolant is passed between hot exhaust plenums 22, 24, 26, 28 twice. As indicated by the directional arrows in the figure, the coolant flows through core 10 in directions perpendicular to the direction of the exhaust flow, i.e., the coolant passages are disposed at ninety-degree angles relative to the exhaust passages. Other configurations are known and contemplated, including configurations wherein the coolant and hot gas flow in parallel, rather than perpendicular, directions. As shown by the directional arrows in FIG. 2, the coolant flows in opposing directions during separate passes through core 10. Coolant flows from the left to right (as viewed in FIG. 2) during the first pass through core 10, and subsequently from right to left during the second pass. There is, in the prior art heat exchanger of FIG. 2, provided some conventional means for reversing the coolant flow between passes through core 10, such as ordinary U-fittings joining the ends of corresponding passages. Sealing divider 40 is provided between opposing pairs of coolant plenum walls to separate the first pass coolant flow from the second-pass coolant flow, without interfering with the exhaust flow through hot exhaust plenums 22, 24, 26, 28. As shown in FIG. 2, divider 40 typically extends the entire dimension of the core. It may be seen and appreciated that in the heat exchanger of FIG. 2 the area-in-flow of first pass coolant plenums 12, 14, 16, 18, 20 is the same as the area-in-flow of second pass coolant plenums 12', 14', 16', 18', 20', such that distance a is equal to distance b.

The coolant is typically a liquid, and thus absent boiling is relatively incompressible. Because the area-in-flow remains constant for all coolant passes through the core, its velocity will remain essentially unchanged, assuming negligible flow friction losses in the system. The foregoing is known in the art of fluid dynamics, and is apparent from the continuity equation for volume discharge of a fluid:

$$Q=VA \tag{1}$$

where Q is the discharge (volume of flow per unit time), and V is the average velocity of the fluid through a cross sectional area A (the area-in-flow). It may thus be seen that since Q is constant for any point in the coolant flow path, the system being closed, V is inversely correlated to A. Thus decreasing A necessarily results in an increase in V, and visa-versa. This has important consequences in the field of heat exchangers, including EGR coolers.

Gas enters a heat exchanger at very high temperature and exits at a much cooler temperature, as a desired result of the heat exchange. If the coolant flow is of equal velocity at all relevant points, then the coolant velocity at the point at which exhaust gas enters a heat exchanger, at which the exhaust gas is at the highest temperature, is the same as the coolant velocity at the point at which exhaust gas exits a heat exchanger, at which the exhaust gas is at the lowest temperature. In prior art heat exchangers, it is known and appreciated that "burn out" or heat damage to the coolant passage and/or exhaust passage is most likely to occur at the area where exhaust gas temperatures are highest, i.e., the area of entry into the heat exchanger.

The present invention addresses and ameliorates the aforementioned problem by changing the velocity of the coolant such that the coolant velocity is highest proximate the exhaust passages wherein the exhaust gas temperatures are highest. Because the heat transfer rate from the exhaust gas to the coolant is correlated to the coolant velocity, presumably due to mechanisms that include a reduction of the boundary layer thickness of coolant adjacent the wall between the coolant plenum and exhaust plenum, locally increasing the coolant velocity in the heat exchanger in the vicinity of exhaust gas inlet results in increased local cooling of the exhaust gas, thereby decreasing excessive heat and local film boiling. This reduces coolant film boiling, and attendant burnout, leaks and thermal cycle fatigue.

Figure 3:
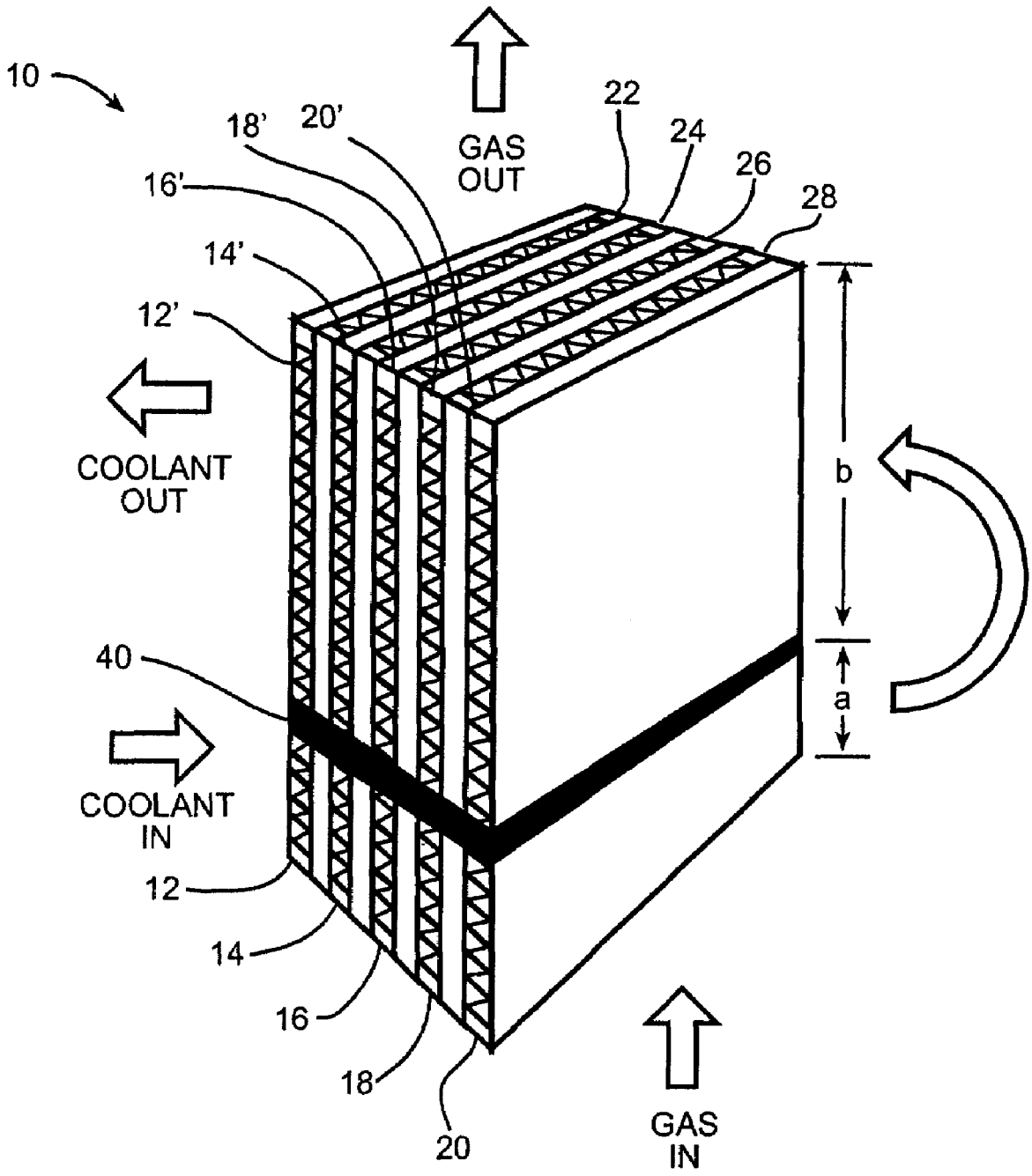
FIG. 3 is a perspective, diagrammatic, bi-section view of an exhaust gas recirculation cooler according to the present invention, showing a single pass exhaust gas configuration with a two pass coolant configuration of unequal passage and areas, such that the area of the pass proximate the gas intake is of smaller area.
Figure 4:
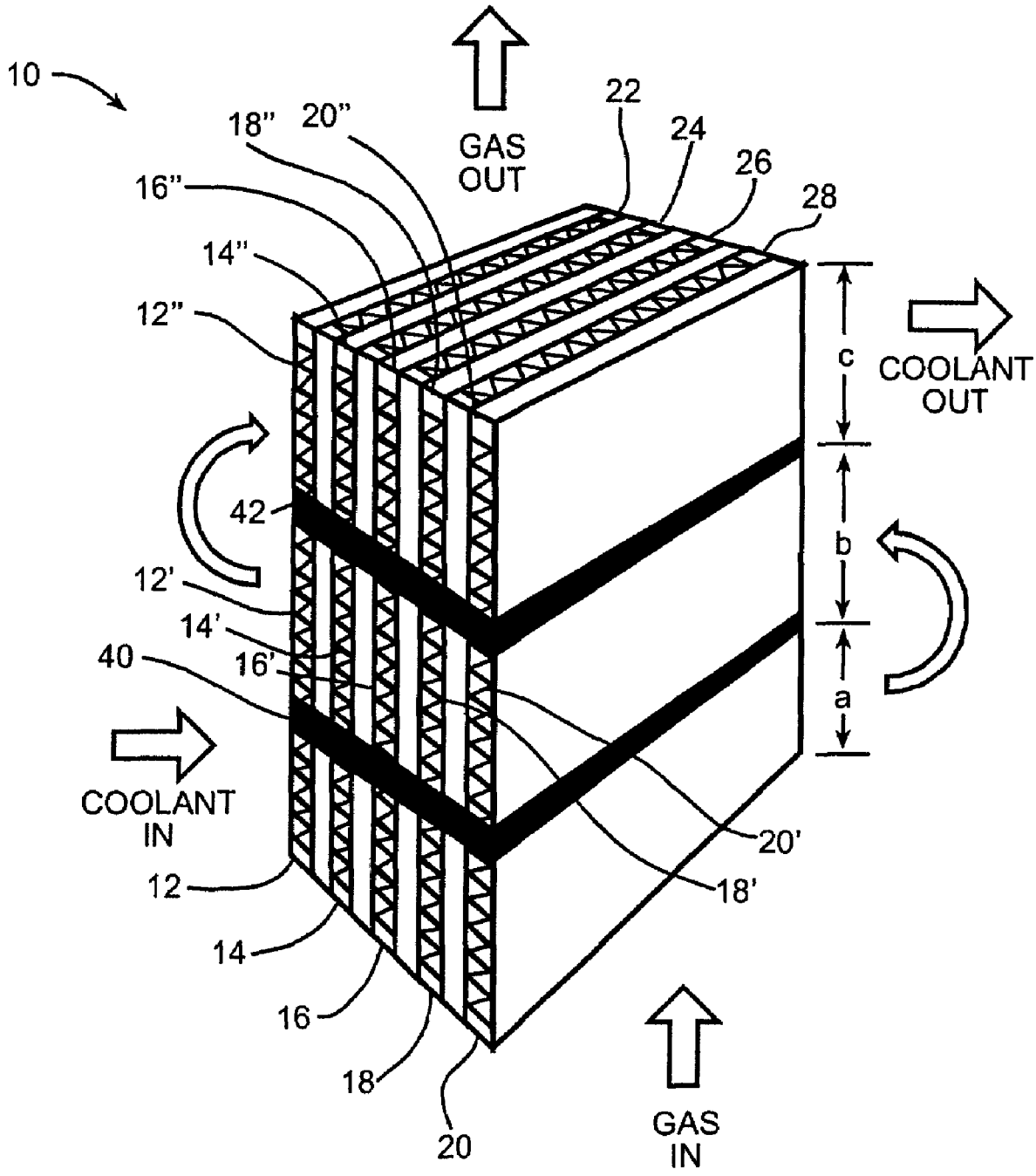
FIG. 4 is a perspective, diagrammatic, bi-section view of an exhaust gas recirculation cooler according to the present invention, showing a single pass exhaust gas configuration with a "three pass" coolant configuration of unequal passage and areas, such that the area of the coolant pass proximate the gas intake is of the smallest area.

FIGS. 3 and 4 depict the fundamentals of one embodiment of the apparatus of the invention. Core 10 of FIG. 3 employs elongated, generally planar divider 40 to separate the coolant flow in first pass coolant plenums 12, 14, 16, 18, 20 from the coolant flow in second pass coolant plenums 12', 14', 16', 18', 20'. Core 10 of FIG. 4 employs two elongated, generally planar dividers 40 and 42, resulting in separated first pass coolant plenums 12, 14, 16, 18, 20, second pass coolant plenums 12', 14', 16', 18', 20', and third pass coolant plenums 12", 14", 16", 18", 20". Referring to FIG. 3, it is seen that an imaginary plane containing divider 40 is generally perpendicular to all the plenums, particularly to exhaust plenums 22, 24, 26, 28, but without obstructing exhaust flow. Such an arrangement is characterized as a "crossflow" configuration. Other embodiments are also possible and contemplated, such as those wherein an imaginary plane containing divider 40 is generally parallel to the plenums, including exhaust plenums 22, 24, 26, 28, such that the coolant is directed in a "folded flow" pattern. The folded flow configuration may be preferred for its simpler construction, and because divider 40 can sit against a solid bar or plenum wall and have a better seal against bypass leakage.

It may be seen that in FIG. 3 that the distance a is less than the distance b. Accordingly the area-in-flow of first pass coolant plenums 12, 14, 16, 18, 20 is less than the area-in-flow of second pass coolant plenums 12', 14', 16', 18', 20', and accordingly the velocity of coolant in first pass coolant plenums 12, 14, 16, 18, 20 is higher than the velocity of coolant in second pass coolant plenums 12', 14', 16', 18', 20'. Due to the inverse correlation, the velocity of coolant in the first pass coolant plenum may, within practical limitations of the specific system, be determined by changing the area-in-flow. Similarly, in FIG. 4 the distance a is less than either the distance b or c, and preferably a<b<c.

Combined reference is made to FIGS. 3 and 4, wherein the inventive apparatus provides multi-pass coolant plenums forming a part of heat exchanger core 10. Core 10 has at least one exhaust plenum 22 for containing exhaust gas, but preferably features a plurality of exhaust plenums 22, 24, 26, 28 of any practical desired number. The exhaust plenums may be single pass, as depicted in FIGS. 3 and 4, or may be multi-pass exhaust plenums. In the case of multi-pass exhaust plenums, such as two pass exhaust plenums, it is only necessary that divider 40 be coextensive with the inlet portion of the first pass exhaust plenum, such that distance a for the inlet portion of first pass exhaust plenum is less than subsequent distance b. Thus in the instance of two pass exhaust plenums, for example coupled with the two pass coolant plenums of FIG. 3, it is only necessary that divider 40 be positioned such that the coolant flow in first pass coolant plenums 12, 14, 16, 18, 20 is separated from the coolant flow in second pass coolant plenums 12', 14', 16', 18', 20' for an area coextensive with the inlet portion of first pass exhaust plenums.

The inventive core 10 of FIGS. 3 and 4 also has at least one first pass coolant plenum 12, and preferably a plurality of first pass coolant plenums 12, 14, 16, 18, 20 for containing flowing coolant. As seen in both FIGS. 3 and 4, each first pass coolant plenum 12, 14, 16, 18 or 20 is adjacent to at least one of exhaust plenums 22, 24, 26, 28. First pass coolant plenum 12 (if single) or the several of them 12, 14, 16, 18 or 20 (if a plurality) defines a first area-in-flow of coolant. Stated differently, if a lone first-pass coolant plenum 12 is employed, the area-in-flow is defined by the dimensions of the one plenum 12; if, as is preferred, a plurality of first-pass plenums are employed, the first area-in-flow is derived from a sum of the plurality's areas-in-flow.

The inventive core 10 of FIGS. 3 and 4 also has at least one second pass coolant plenum 12', and preferably a plurality of second pass coolant plenums 12', 14', 16', 18', 20' for containing flowing coolant. Each of second pass plenums 12', 14', 16', 18' or 20' is adjacent to at least one of exhaust plenums 22, 24, 26, 28. Second pass coolant plenum 12' (if single) or the several of them 12', 14', 16', 18' or 20' (if a plurality) defines a second area-in-flow of coolant. Importantly, the first area-in-flow, defined by the first pass coolant plenum(s), is less, and preferably substantially less, than the second area-in-flow, defined by the second pass coolant plenum(s). Accordingly, the velocity of flowing coolant in the first pass coolant plenum(s) is greater, and preferably substantially greater, than the velocity of flowing coolant in the second pass coolant plenum(s).

As shown in FIG. 4, it is also possible and contemplated that third pass coolant plenums 12", 14", 16", 18", 20" are provided. In FIG. 4, first area-in-flow, defined by one or more of first pass coolant plenums 12, 14, 16, 18, 20, is less, and preferably substantially less, than either the second area-in-flow, defined by one or more of second pass coolant plenums 12', 14', 16', 18', 20', or the third area-in-flow, defined by one or more of third pass coolant plenums 12", 14", 16", 18", 20". Preferably, the area-in-flow of first pass coolant plenums 12, 14, 16, 18, 20 is less, and preferably substantially less, than the second area-in-flow, defined by one or more of second pass coolant plenums 12', 14', 16', 18', 20', which in turn is less, and preferably substantially less, than the third area-in-flow, defined by one or more of third pass coolant plenums 12", 14", 16", 18", 20". Accordingly, the velocity of flowing coolant in the first pass coolant plenum(s) is greater, and preferably substantially greater, than the velocity of flowing coolant in the second pass coolant plenum(s), which velocity is in turn greater, and preferably substantially greater, than the velocity of flowing coolant in the third pass coolant plenum(s). However, it is also possible and contemplated that, for example, the second and third pass coolant plenums are of equal area-in-flow, the area-in-flow of each of which is less, and preferably substantially less, than that of the first pass coolant plenums. It may be that even where the area-in-flow of the second and third pass coolant plenums are equal, that the dimensions of such plenums differ. The velocity of flowing coolant in the first pass coolant plenum(s) is greater, and preferably substantially greater, than the velocity of flowing coolant in either the second pass coolant plenum(s) or third pass coolant plenum(s). In one embodiment, the area-in-flow of the first pass coolant plenum is on the order of 10 square inches, while the second and third pass coolant plenums area-in-flow is on the order of 15 square inches.

It is seen that in a crossflow embodiment, such as seen in FIG. 3, the number of first pass coolant plenums 12, 14, 16, 18, 20 equals the number of second pass coolant plenums 12', 14', 16', 18', 20'; the difference in respective areas-in-flow between the passes is realized by providing the second pass coolant plenums 12', 14', 16', 18', 20' with smaller effective dimension (e.g. dimension a in FIG. 3). In a folded-flow embodiment, the difference in respective areas-in-flow between the two passes can be provided by having a lesser number of first pass coolant plenums 12, 14, 16, 18, 20 than of second pass coolant plenums 12', 14', 16', 18', 20'. Such difference in areas-in-flow can be any convenient ratio between the aggregate first pass area-in-flow and the aggregate second pass area-in-flow that will result in the desired velocity, such as a ratio of from about 1:1.3 to about 1:2.

Computer modeling has established that application of the invention as embodied in FIGS. 3 and 4 result in decreased maximum temperature of the coolant plenum wall for the first pass. As shown below, a heat transfer performance program was used to determine surface temperature at a test operating condition for a prior art two pass folded coolant plenum of FIG. 2 (where a=b), for a prior art three pass folded coolant plenum (where a=b=c), and for a three pass folded and parallel coolant plenum of FIG. 4 (where a<b<c). Table 1 reflects the percent of the resulting temperature of the film boiling initiation temperature using the three coolant plenums.

TABLE 1

| Coolant Plenum | Percent of Film Boiling Initiation Temperature |
|---|---|
| Two Pass Equal Velocity (a = b) | 113% |
| Three Pass Equal Velocity (a = b = c) | 108% |
| Three Pass Unequal Velocity (a < b < c) | 94% |

It may thus be seen that while some decrease in temperature is seen in three pass equal velocity as compared to a two pass equal velocity coolant plenums, presumably due to the increase in velocity with equal three pass as compared to equal two pass coolant plenums, a greater decrease in temperature is seen with three pass unequal velocity coolant plenums as compared to three pass equal velocity coolant plenums. This decrease in temperature is sufficient to decrease or eliminate damaging transition boiling, such as film boundary surface boiling.

In another embodiment, the invention provides tank shaping and baffling at the outlet of the cooling plenum, which shaping and baffling results in increased velocity, with concomitant decreased boundary layers, for that portion of the coolant plenum(s) adjacent to the gas exhaust inlet side of the first pass exhaust plenum. Thus the tank, such as a coolant outlet manifold, collects coolant on the coolant out side of the core, and directs the coolant to a suitable conduit, such as tubes or pipes. The interior of the tank is shaped and/or baffled such that the velocity in discrete portions of one or more coolant plenum(s), or in the entirety of one or more of the coolant plenum(s), is varied. It is thus provided in this way to locally change the velocity of the coolant such that the coolant velocity is highest proximate the exhaust passages wherein the exhaust gas temperatures are highest. Because the heat transfer rate from the exhaust gas to the coolant is correlated to the coolant velocity, presumably due to mechanisms that include a reduction of the boundary layer thickness of coolant adjacent the wall between the coolant plenum and exhaust plenum, locally increasing the coolant velocity in the heat exchanger in the vicinity of exhaust gas inlet results in increased local cooling of the exhaust gas, thereby decreasing excessive heat and local film boiling. This thus reduces coolant film boiling and thermal cycle fatigue.

Figure 5:
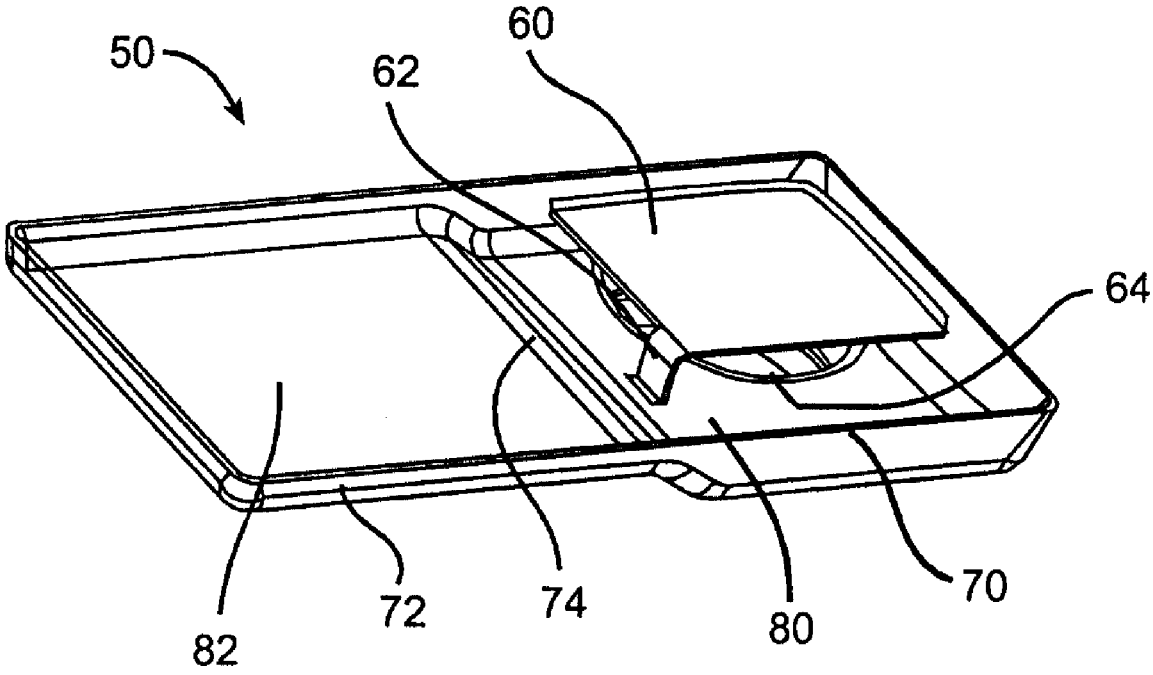
FIG. 5 is a perspective, diagrammatic view of a coolant outlet tank assembly according to the present invention, showing a varied tank depth and baffle.

FIG. 5 depicts the fundamentals of one embodiment of a tank or coolant outlet manifold of the invention. Coolant outlet tank assembly 50 of FIG. 5 is typically made of a metallic substance, such as 304 stainless steel. Baffle 60 is provided, including support 62, which is in front of exit pipe 64, thereby preventing a clear path through the core into exit pipe 64, and biasing the flow through the part of the core adjoining the open area 80. The coolant plenum(s) discharging into open area 80 is proximate to the gas inlet portion of the exhaust plenum. In part because of the increased depth of open area 80, resulting from the height of side wall 70, the velocity of flow through that portion of the coolant plenum(s) discharging into open area 80 is increased, compared to the remaining portions of the coolant plenum(s). The remaining portion of tank assembly 50 includes open area 82, which has a decreased depth compared to open area 80, due to the decreased height of side wall 72, with a sloping transition zone 74 connecting open areas 80 and 82. Because of the decreased depth of open area 82, flow is restricted as coolant exits the coolant plenum(s), resulting in decreased velocity of flow through that portion of the coolant plenum(s) discharging into open area 82.

Figure 6:
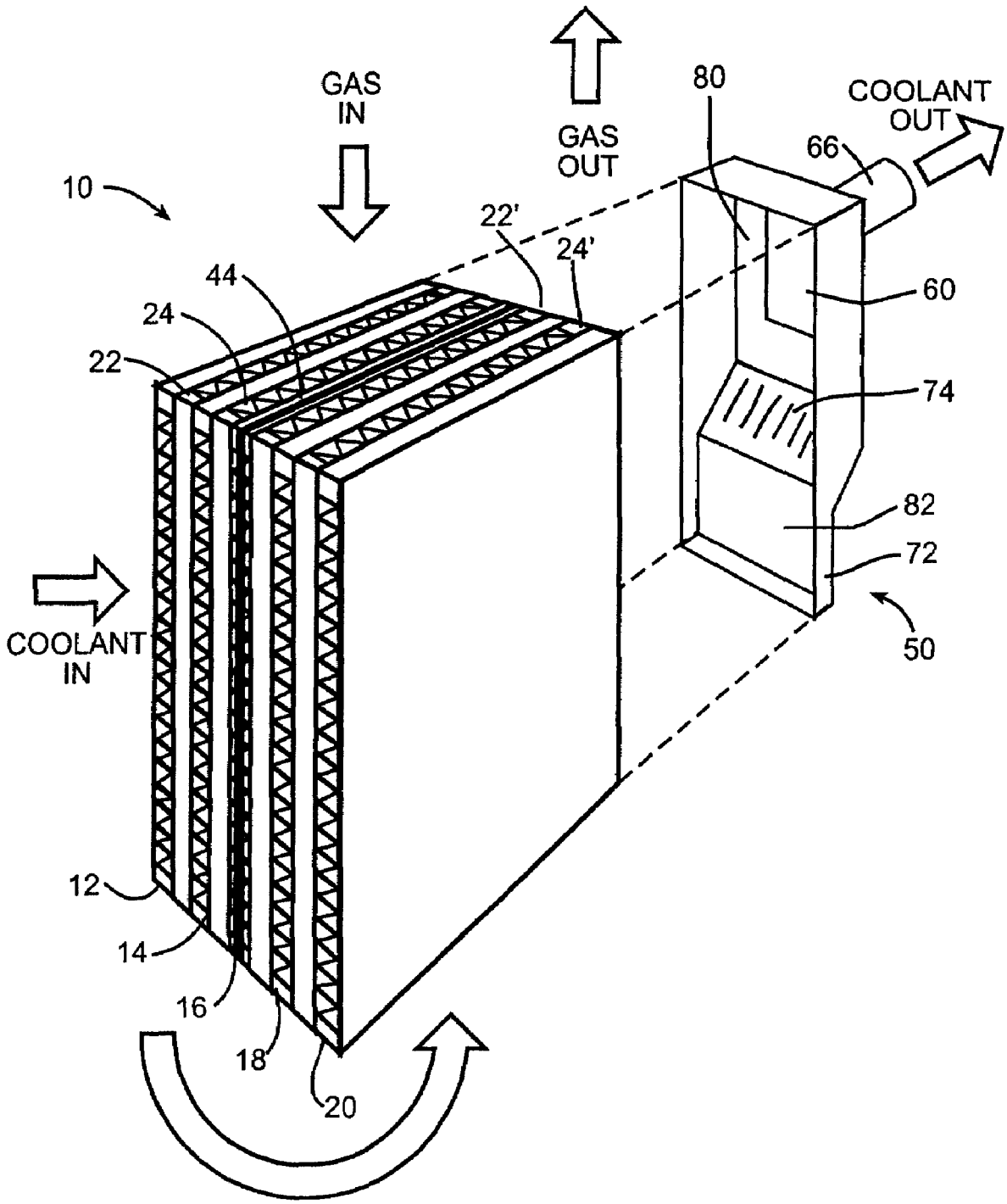
FIG. 6 is a perspective, diagrammatic view of a coolant outlet tank assembly according to the present invention, in combination with a perspective, diagrammatic, bi-section view of an exhaust gas recirculation cooler from the prior art, showing a double pass exhaust gas configuration in combination with a single pass coolant configuration.

FIG. 6 depicts core 10 in combination with coolant outlet tank assembly 50. Core 10 provides for two pass gas exhaust plenums, separated by planar exhaust divider 44 to separate the exhaust gas flow in the first pass exhaust plenums 22, 24 from the exhaust gas flow in the second pass exhaust plenums 22', 24'. The first pass exhaust plenums 22, 24 are located at the point of gas inlet, wherein the exhaust gas temperature is highest. This is proximate those portions of coolant plenums 12, 14, 16 that discharge into open area 80. Thus the velocity is locally increased through such portions of the coolant plenums, and the boundary layer correspondingly decreased. The coolant exits through coolant outlet 66, the opening of which is partially covered by baffle 60.

It may readily be appreciated that other tank shapes, configurations of baffles, and the like are both possible and contemplated, so long as the result is increased coolant velocity and/or decreased boundary layer in at least those portions of the cooling plenum(s) adjacent to the exhaust gas inlet portion of the exhaust plenum(s), such as the inlet portion of first pass exhaust plenum(s) in a multi-pass exhaust plenum core. The relative depths of open areas, such as open areas 80 and 82, may be varied, one or more baffles may optionally be employed, and like. Thus the flow may be obstructed, such as by tank depth, tank surface structures, baffles or the like, in areas where decreased coolant velocity is acceptable, and flow correspondingly increased in areas where increased coolant velocity is desired, such as adjacent to the exhaust gas inlet portion of the first pass exhaust plenums. It is also possible that the baffle shape(s) may be varied, and may be planer, corrugated, curved or the like. Baffle shapes may further be employed to more directly distribute the coolant flow as desired. Exit pipe 64 may similarly be positioned so as to provide for the desired variance in coolant velocity.

The temperature was compared by utilizing thermocouples attached to the bar, corresponding to planar divider 44, on the gas exhaust side of the bars, and measuring the bar temperature at each end and in the middle of the bar. A coolant outlet tank assembly was provided with no tank shaping or baffling, and was compared to a coolant outlet tank assembly corresponding to tank 50, wherein a flat baffle was employed together with a tank shaping. Under comparable operating conditions, results were obtained as shown in Table 2.

TABLE 2

| | Percent Reduction of Temperature | | |
|---|---|---|---|
| Tank | First Bar End | Middle Bar | Second Bar End |
| Tank with Shaping and Baffling | 27% | 34% | 33% |

It may thus be seen that use of a tank with shaping and baffling resulted in substantially decreased bar temperature as measured on the exhaust side.

It may further be readily appreciated that while the tank shaping and baffling is depicted on coolant outlet tank 50, it is also possible to obtain similar results by similar modification of the coolant inlet tank assembly. Thus a coolant inlet tank may be shaped and baffled such that the highest velocity of coolant is directed through those portions of the cooling plenum(s) adjacent to the exhaust gas inlet portion of the exhaust plenum(s), such as the inlet portion of first pass exhaust plenum(s) in a multi-pass exhaust plenum core. The remaining cooling plenum(s) or portions of cooling plenum(s) have a comparatively lower coolant velocity.

While the device of FIG. 6 shows single pass coolant plenums, it may further be appreciated that a multi-pass coolant design, with increased coolant velocity in the first pass coolant plenums, may be combined with coolant outlet tank assembly 50, such that both coolant plenums configuration and the coolant outlet tank design and configuration contribute to increased coolant velocity through those portions of the cooling plenums adjacent to the exhaust gas inlet portion of the exhaust plenums, such as the inlet portion of first pass exhaust plenums in a multi-pass exhaust plenum core. In such instance, the shaped and/or baffled tank may be an inlet tank, or may be an outlet tank for the first pass coolant plenum(s) that further directs coolant into the second pass coolant plenum(s).

From the foregoing, it is apparent that the present invention includes innovative methods for providing more effective cooling to the hottest portion of the exhaust gas, that being the exhaust gas as it enters the core. In one embodiment, the method includes the steps method for cooling recirculated exhaust, the method comprising: directing heated exhaust through at least one exhaust plenum with an inlet and an outlet, the highest temperature of such exhaust being at the inlet; conveying coolant through at least one coolant plenum disposed adjacent to the at least one exhaust plenum; defining a first area within the coolant plenum adjacent to the exhaust plenum inlet and a second area within the coolant plenum not adjacent to the exhaust plenum inlet; configuring the coolant plenum such that the velocity of coolant adjacent to the exhaust plenum in the first area is greater than the velocity of coolant adjacent to the exhaust plenum in the second area; and permitting heat energy to be removed from the exhaust by coolant convection. In the method, the coolant plenum may be configured by any of several means. In one means, the velocity is increased in the first zone relative to the second zone by decreasing the area-in-flow of the first zone relative to the second zone. In another means, either the inlet or outlet tank, or both, are shaped or baffled, or both, such that coolant velocity in the first zone is greater than coolant velocity in the second. In yet another means, combinations of the foregoing are employed.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. A heat exchanger comprising:

a heat exchanger inlet for receiving flowing heated fluid at an inlet temperature and a heat exchanger outlet for discharging flowing heated fluid at an outlet temperature, the outlet temperature less than the inlet temperature;

at least one exhaust plenum for containing flowing heated fluid, each exhaust plenum having at least one inlet receiving flowing heated fluid and at least one outlet for discharging flowing heated fluid, said inlet(s) spaced from said outlet(s);

at least one liquid coolant plenum for containing flowing liquid coolant, the liquid coolant plenum contacting one or more adjacent exhaust plenums and having at least one first zone adjacent to at least one inlet of each of the one or more adjacent exhaust plenums, the at least one inlet receiving heated fluid from the heat exchanger inlet, and at least one second zone adjacent to at least one outlet of each of the one or more adjacent exhaust plenums; and at least one tank in fluidic connection with the at least one liquid coolant plenum, the tank comprising at least one of shaping or baffling such that the velocity of flowing liquid coolant in the at least one first zone is greater than the velocity of flowing liquid coolant in the at least one second zone to thereby reduce liquid coolant film boiling;

wherein flow is restricted in the second zone relative to the first zone by means of at least one of shaping or baffling.

2. The apparatus according to claim 1, wherein the tank is an outlet tank.

3. The apparatus according to claim 1, wherein the tank is an inlet tank.

4. The apparatus according to claim 1, wherein the tank comprises shaping and baffling.

5. The apparatus according to claim 1, wherein the liquid coolant plenum makes at least two passes contacting exhaust plenum, the first liquid coolant pass comprising the at least one first zone, and wherein the area-in-flow of the first liquid coolant pass is less than the area in flow of any subsequent liquid coolant pass.

6. The heat exchanger of claim 1 wherein liquid coolant in the at least one first zone and in the at least one second zone flow in parallel.

7. A heat exchanger comprising:

a heat exchanger inlet for receiving flowing heated fluid at an inlet temperature and a heat exchanger outlet for discharging flowing heated fluid at an outlet temperature, the outlet temperature less than the inlet temperature;

at least one exhaust plenum for containing flowing heated fluid, each exhaust plenum having at least one inlet receiving flowing heated fluid and at least one outlet for discharging flowing heated fluid, said inlet(s) spaced from said outlet(s);

at least one liquid coolant plenum for containing flowing liquid coolant, the liquid coolant plenum contacting one or more adjacent exhaust plenums and having at least one first zone adjacent to at least one inlet of each of the one or more adjacent exhaust plenums, the at least one inlet receiving heated fluid from the heat exchanger inlet, and at least one second zone adjacent to at least one outlet of each of the one or more adjacent exhaust plenums; and at least one tank in fluidic connection with the at least one liquid coolant plenum, the tank comprising at least one of shaping or baffling such that the velocity of flowing liquid coolant in the at least one first zone is greater than the velocity of flowing liquid coolant in the at least one second zone to thereby reduce liquid coolant film boiling;

wherein the liquid coolant plenum makes at least two passes contacting exhaust plenum, the first liquid coolant pass comprising the at least one first zone, and wherein the area-in-flow of the first liquid coolant pass is less than the area in flow of any subsequent liquid coolant pass.

8. The apparatus according to claim 7, wherein the tank is an outlet tank.

9. The apparatus according to claim 7, wherein the tank is an inlet tank.

10. The apparatus according to claim 7, wherein the tank comprises shaping and baffling.

11. The apparatus according to claim 7, wherein flow is restricted in the second zone relative to the first zone by means of at least one of shaping or baffling.

12. The heat exchanger of claim 7 wherein liquid coolant in the at least one first zone and in the at least one second zone flow in parallel.

* * * * *